United States Patent [19]

Bayer et al.

[11] Patent Number: 4,720,950

[45] Date of Patent: Jan. 26, 1988

[54] SPACERS FOR USE IN MULTIPLE-PANE WINDOWS OR THE LIKE

[75] Inventors: Franz Bayer, Elzach; Karl Grosch, Wuppertal, both of Fed. Rep. of Germany

[73] Assignee: Franz Xaver Bayer Isolierglasfabrik, Elzach, Fed. Rep. of Germany

[21] Appl. No.: 890,621

[22] Filed: Jul. 25, 1986

Related U.S. Application Data

[62] Division of Ser. No. 598,444, Apr. 9, 1984, Pat. No. 4,627,263.

[30] Foreign Application Priority Data

Apr. 9, 1983 [DE] Fed. Rep. of Germany ..... 3312764
Oct. 12, 1983 [DE] Fed. Rep. of Germany ..... 3337058

[51] Int. Cl.[4] ..... E06B 7/12
[52] U.S. Cl. ..... 52/172; 52/790
[58] Field of Search ..... 52/172, 790, 398, 399; 428/34

[56] References Cited

U.S. PATENT DOCUMENTS 4,261,145 4/1981 Bröcking ..... 52/172
4,322,926 4/1982 Wolflingseder et al. ..... 52/172

FOREIGN PATENT DOCUMENTS 2457475 6/1976 Fed. Rep. of Germany ..... 428/34
2929544 6/1982 Fed. Rep. of Germany .
3047338 1/1983 Fed. Rep. of Germany .
3337058 2/1985 Fed. Rep. of Germany .
926881 5/1963 United Kingdom ..... 52/399

*Primary Examiner*—Carl D. Friedman
*Attorney, Agent, or Firm*—Peter K. Kontler

[57] ABSTRACT

Elbows in tubular blanks which are filled with a desiccant are formed by clamping a blank at one side of the intended locus of the elbow, by bending the blank at the other side of the intended locus of the elbow relative to the clamped portion of the blank, by propping the blank in the region of the inner wall of the developing elbow, and by plasticizing the material of the blank in the region of the outer wall of the developing elbow so that the material of such outer wall is less likely to exhibit cracks and/or to burst as a result of bending of the blank.

16 Claims, 7 Drawing Figures

SPACERS FOR USE IN MULTIPLE-PANE WINDOWS OR THE LIKE

This application is a division of application Ser. No. 598,444 filed Apr. 9, 1984, now U.S. Pat. No. 4,627,263.

BACKGROUND OF THE INVENTION

The present invention relates to improvements in spacers which are used between the marginal portions of panes in multiple-pane windows or the like. More particularly, the invention relates to spacers which constitute converted normally straight tubular blanks and which have one or more bends (hereinafter called elbows) each flanked by two normally straight sections of the deformed tubular blank. Such spacers are used between the panes of multiple-pane windows to prevent the penetration of moisture and/or solid contaminants into the space between the neighboring panes as well as to absorb moisture which happens to penetrate into or which has remained in such space. To this end, the spacers contain supplies of a desiccant and are provided with perforations or other types of holes which allow for communication between the interior of the spacer and the space between the major portions of the panes. As a rule, the elbow is a 90-degree bend so that the straight sections of the spacer can remain close to the marginal portions of the panes in a multiple-pane structure having a rectangular or square outline.

U.S. Pat. No. 4,261,145 to Bröcking discloses spacers for multiple-pane windows as well as a method of and an apparatus for making the spacers. The blanks are elongated tubular bodies which are filled with desiccant and are bent in such a way that the ends of the resulting spacers are remote from the corners of the panes in order to facilitate coupling of the ends of a single spacer or of the ends of two or more discrete spacers to each other in order to form a circumferentially complete spacer which extends along all marginal portions of the respective pair of panes. Even though the patent to Bröcking also refers to the making of miter joints at the corners of neighboring panes, it discloses the making of butt joints in regions other than the corners of a multiple-pane window. There is also disclosed the possibility of bending an elongated tubular blank at four spaced locations so as to obtain a one-piece spacer whose ends are joined by a suitable coupling insert to thus obtain a circumferentially complete distancing device extending along all four marginal portions of the neighboring panes. A drawback of the patented proposal is that the walls of the tubular blank are likely to burst or break in response to pronounced bending, especially in view of the fact that the blank is filled with a desiccant which resists bending of the adjoining walls of the blank in order to form a 90-degree elbow. Therefore, the patentee proposes to evacuate a certain amount of desiccant by vibrating the tubular blank. This contributes to complexity of the apparatus and necessitates the provision of means for intercepting the escaping desiccant for renewed use. Moreover, evacuation of a certain amount of desiccant from the regions where the blank is to be formed with elbows fails to invariably prevent cracking or bursting of the bent portions of a blank because some of the material of the blank must expand and some material must contract during the making of one or more elbows. Cracking of the blank during the making of one or more elbows results in the establishment of communication between the compartment for desiccant and the surrounding atmosphere so that the desiccant is rapidly saturated and is incapable of withdrawing moisture from the space between the neighboring panes. The result is rapid clouding or fogging of the multiple-pane window. The problem is aggravated due to the fact that, as a rule, the manufacturer wishes to make elbows with small or very small radii of curvature in order to ensure that each elbow will extend close to the respective corners of the neighboring panes. This ensures that the elbow is less likely to be visible, or is not visible at all, in the fully assembled multiple-window pane. The making of such elbows with minute radii of curvature renders it even more likely that the entrapped desiccant will cause the material of the spacer at the outer side of the elbow to break or burst as a result of pronounced elongation during bending of the tubular blank around a mandrel or the like.

German Pat. No. 30 47 338 discloses a modified tubular blank for conversion into spacers which can be used between the marginal portions of panes in multiple-pane windows. In accordance with the proposal which is disclosed in this patent, the blank contains a first longitudinally extending compartment which is filled with a suitable desiccant and a second longitudinally extending compartment which is empty and is outwardly adjacent to the first compartment when the blank is converted into a spacer with one or more elbows. Consequently, the wall at the outer side of the empty compartment undergoes maximum elongation during the making of an elbow whereby the walls bounding the compartment which contains the desiccant are less likely to burst during bending of such blank. The just described blank is quite satisfactory and is much less likely to burst during bending than the blank of Bröcking. However, the cost of the twin-compartment blank is much higher and the dimensions of such blank (as considered at right angles to the longitudinal direction of the blank) are greater so that the spacer cannot be readily concealed in the fully assembled multiple-pane window.

In accordance with a further proposal, bending of a tubular desiccant-filled blank is facilitated by weakening that wall of the blank which is located at the inner side of the elbow in a completed spacer. The weakening is effected by removing some material to form in the inner wall grooves, blockouts and analogous formations which render the respective wall more readily pliable and thus reduce the overall resistance of the blank to bending. The weakened portions have perforations which establish communication between the interior of the spacer and the space between the respective panes. Since the desiccant invariably undergoes a pronounced grinding or other comminuting action while a straight piece of tubular blank is being converted into an elbow, the comminuted desiccant penetrates from the interior of the elbow into the space between the panes when the multiple-pane window is fully assembled. This detracts from the appearance of the finished product. In fact, and since the panes in a finished window invariably have some freedom of movement relative to one another, e.g., in response to changes in temperature, these panes act not unlike a suction pump whenever they move apart to thereby draw additional desiccant from the holes at the inner side of an elbow. Such pumping action can entail migration of relatively large quantities of comminuted desiccant from the interior of the elbow into the space between the neighboring panes.

OBJECTS AND SUMMARY OF THE INVENTION

An object of the invention is to provide a novel and improved blank which can be used for conversion into spacers for use between the panes of multiple-pane windows or the like.

A further object of the invention is to provide a spacer which is obtained from the above outlined blank.

Another object of the invention is to provide a multiple-pane window or an analogous planar product which employs the improved spacer.

The invention resides in the provision of a novel and improved spacer for use in multiple-pane wndows or the like which comprises an elongated member including an elbow and two normally straight sections flanking the elbow. The member has a tubular portion which contains a supply of desiccant so that it is at least partially filled with the drying agent, and two extensions which extend laterally of the tubular portion and are spaced apart from one another. The distance between the outer sides of the extensions exceeds the distance between the outer sides of two sidewalls of the tubular portion of such member. The tubular portion can have a substantially rectangular, square or trapeziform cross-sectional outline. The outer side of each sidewall can be provided with a longitudinally extending recess for a sealing and/or insulating compound, and the tubular portion includes an inner wall whose marginal portions are adjacent to the respective recesses. Such marginal portions are integral with the respective sidewalls and the aforementioned extensions extend inwardly from the marginal portions of the inner wall of the tubular portion so that they can contact the inner sides of the respective panes inwardly of the tubular portion of the spacer. Each extension can be provided with a bevelled or chamfered end face which is remote from and slopes inwardly toward the median portion of the inner wall. Such bevelled end faces make an angle of less than 180 degrees (e.g., an angle approximating 90 degrees), and the tubular portion can include two mutually inclined outer walls each of which is at least substantially parallel to the bevelled end face of the respective extension; this allows for the stacking of a number of spacers in a small area by placing the bevelled end faces of the extensions of one spacer against the outer sides of the outer walls of the neighboring spacer.

The thickness of the outer wall or walls of the tubular portion of the spacer preferably exceeds the thickness of the other walls (inclusive the extensions), except possibly at the outer side of the elbow because the material at such outer side of the elbow is spread apart as a result of plasticizing of the second portion of the third part of the respective blank in the course of the bending operation. The inner side of the inner wall of the tubular portion of the spacer (i.e., that side of the inner wall which is contacted by the confined desiccant) is preferably provided with at least one longitudinally extending protuberance having a small or minimal height and preferably having a substantially triangular cross-sectional outline. Such projection or projections can be engaged and deformed by an insert which is used to couple one end of the spacer to the other or to couple one end of a first spacer with one end of a second spacer.

At least a portion of the inner and/or outer wall of the tubular portion of the spacer can have an arcuate shape, e.g., with the concave side facing inwardly and the convex side facing outwardly.

The outer sides of the sidewalls and/or the outer sides of the extensions of the spacer can be provided with layers of a suitable sealing compound. Distancing means in the form of cords, spheres and/or other configurations can be at least partially embedded in such layers. The distancing means can consist of or contain an elastomeric material, such as natural or artificial rubber. If the layers of sealing compound are applied to the outer sides of the extensions, they sealingly contact the inner sides of the respective panes when the spacer is inserted between the marginal portions of two panes. The sealing compound can include or constitute a mass of thermally insulating material. The distancing means can be dimensioned and installed in such a way that they contact the inner sides of the respective panes when the spacer is installed in a multiple-pane window or the like, i.e., the distancing means can extend beyond the external surfaces of the respective extensions of the spacer.

The novel features which are considered as characteristic of the invention are set forth in particular in the appended claims. The improved spacer itself, however, together with additional features and advantages thereof will be best understood upon perusal of the following detailed description of certain specific embodiments with reference to the accompanying drawing.

DESCRIPTION OF THE PREFERRED EMBODIMENTS

Figure 1:
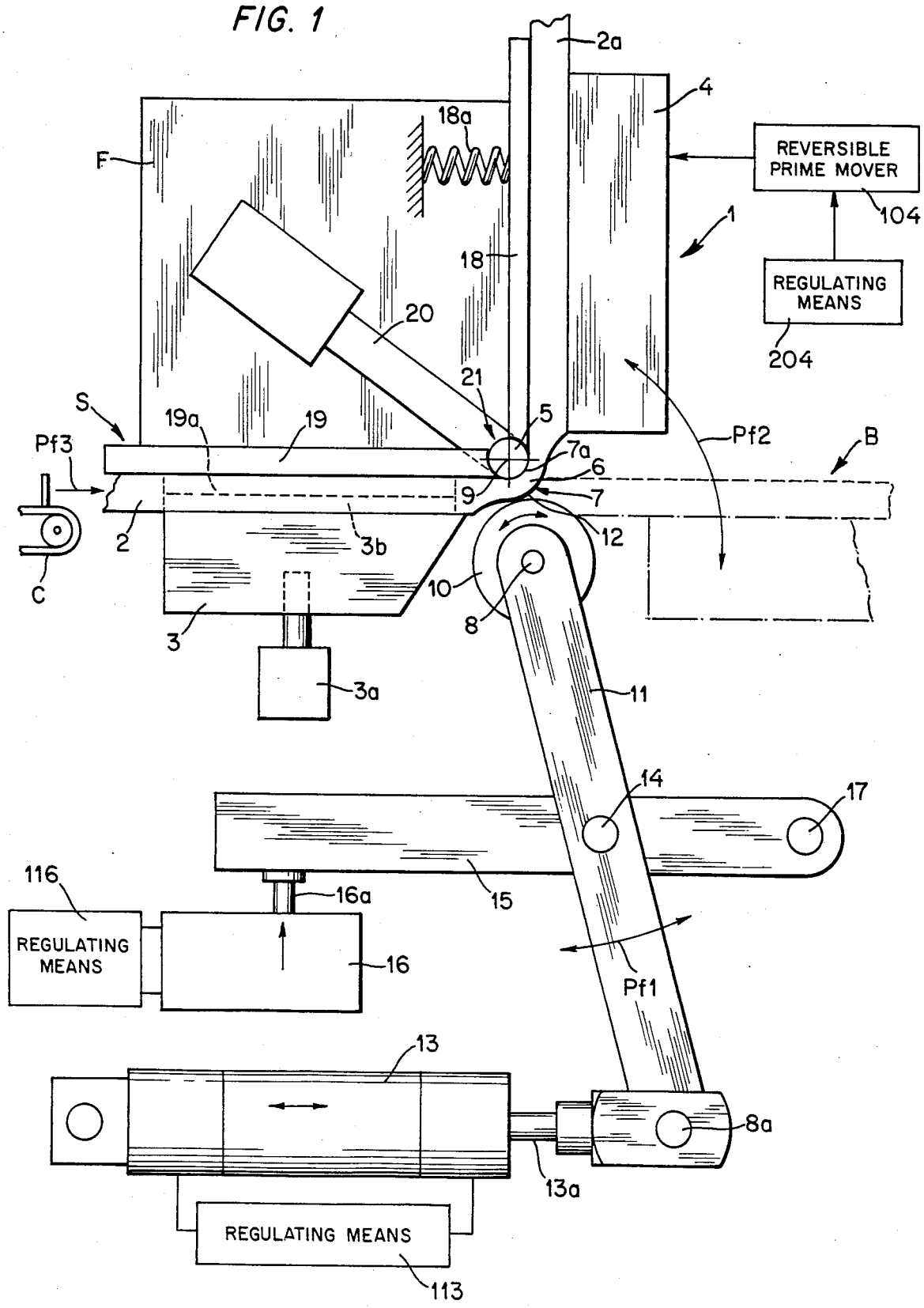
FIG. 1 is a schematic elevational view of an apparatus for making the improved spacer wherein the means for moving a rotatory plasticizing tool includes two interconnected crossing two-armed levers.
Figure 3:
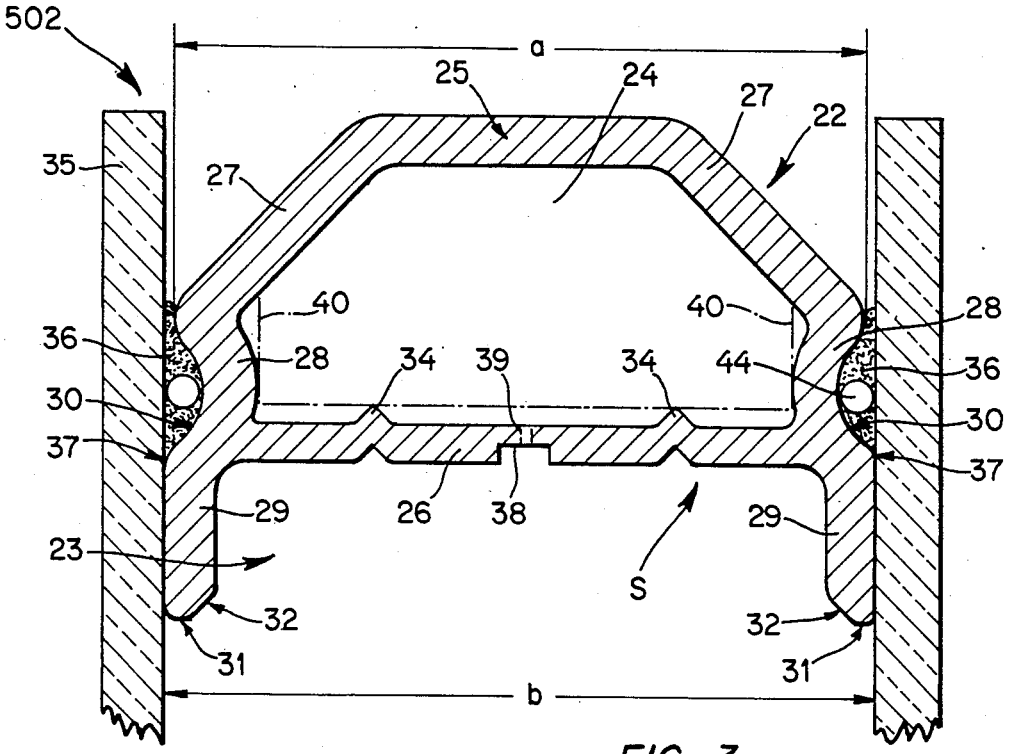
FIG. 3 is a fragmentary sectional view of a multiple-pane window and of a relatively wide spacer between the marginal portions of two panes of the window, the spacer being of the type which can be formed in the apparatus of FIG. 1 or 2.

Referring first to FIG. 1, there is shown an apparatus which is used to convert an elongated straight tubular blank B into a substantially L-shaped spacer S, e.g., a spacer of the type shown in section in FIG. 3. This spacer has a tubular portion 22 with a longitudinally extending compartment 24 which is filled with a desiccant, and an inner portion 23 with two spaced-apart parallel longitudinal extensions 29 which are disposed inwardly of the compartment 24 when the spacer S is installed between the marginal portions of two window panes 35 to form with the panes a constituent of or an entire multiple-pane window 502. The latter can comprise two, three or more panes 35 with a discrete circumferentially complete spacer between each pair of neighboring panes.

FIG. 1 shows the blank B upon conversion into a portion of or into a finished spacer S, depending upon whether the spacer is to have one, two or more elbows 6. The converted blank B (i.e., the spacer S) of FIG. 1 comprises a first straight section 2 which constitutes a converted first part of the blank B, a second straight section 2a which constitutes a converted second part of the blank B, and the elbow 6 which constitutes a converted third part of the blank B between the first and second parts. The elbow 6 has an arcuate outer wall 7 and an arcuate inner wall 7a whose center of curvature is or can be identical with that of the outer wall 7. The spacer S of FIG. 1 has an elbow 6 which makes an angle of approximately or exactly 90 degrees because it is intended to be used between two panes 35 each of which has a rectangular or square outline.

The apparatus of FIG. 1 comprises a clamping device including a stationary clamping jaw 19 and a mobile clamping jaw 3 movable toward and away from the jaw 19 by a suitable motor 3a (e.g., a fluid-operated motor of any known design) so that the first part of the blank B (i.e., the first section 2 of the spacer S) is safely held in the course of the converting operation.

The apparatus further comprises a bending device 1 which includes a jaw 4 movable between the solid-line and the phantom-line positions of FIG. 1 in the plane of the drawing so as to move the second part (section 2a) of the blank B from a position of alignment with the first part (section 2) to a position at right angles to the original position (as actually shown in FIG. 1). The means for moving the jaw 4 between the two end positions includes a suitable reversible prime mover 104 and regulating means 204 which is designed to move the jaw 4 back and forth in directions indicated by a double-headed arrow Pf2, preferably at a relatively high frequency and in such a way that the angular movements of the jaw 4 in a counterclockwise direction, as viewed in FIG. 1, increase in stepwise fashion with the result that the inclination of the section 2a with reference to the section 2 increases gradually until it reaches the illustrated value (90 degrees). The bending device 1 further comprises a second clamping element or jaw 18 which is disposed opposite the jaw 4 and is biased in a clockwise direction by a suitable spring 18a so as to ensure that the section 2a is held between the jaws 4 and 18 and is braced by the jaw 18 without wobbling while the prime mover 104 moves the jaw 4 in directions indicated by the arrow Pf2. The jaw 18 can be integrally or separably connected with an abutment 5, e.g., a horizontal cylindrical mandrel which is mounted in the frame F of the apparatus and is adjacent to the inner wall 7a of the elbow 6, i.e., to the inner wall of that (third) part of the blank B which is in the process of being converted into the elbow 6. The diameter of the abutment or mandrel 5 largely determines the radius of curvature of the inner wall 7a of the elbow 6; such radius can be less than three centimeters, normally not in excess of two centimeters and often as small as one centimeter.

Fresh blanks B are supplied by a suitable conveyor C in the direction which is indicated by the arrow Pf3, i.e., in such a way that the first parts (future sections 2a) and second parts (future elbows 6) of successive blanks B pass through the clamping device 3, 3a, 19 ahead of the respective first parts (future sections 2). The exact details of the means for feeding fresh blanks (which can be severed from a continuous tubular blank at predetermined intervals with a saw or the like) form no part of the present invention.

The apparatus further comprises means for plasticizing at least that portion of the third part of the blank held by the clamping means 3, 3a, 19 which is to constitute the outer wall 7 of the elbow 6. At the same time, the plasticizing means serves to displace a certain amount of desiccant from the third part of the blank B preparatory to and/or during conversion of such third part into the elbow 6 of the spacer S. The plasticizing operation results in a lengthening or stretching of that portion of the third part of the blank B which is converted into the outer wall 7 so that the latter is highly unlikely to crack, burst and/or break in the course of the making of elbow 6. Still further, such treatment of the material of the outer wall 7 preparatory to and/or during the making of the elbow 6 in the space between the clamping and bending devices ensures that the external surface of the outer wall 7 is smooth as well as that the external surface of the inner wall 7a (adjacent to the peripheral surface of the abutment 5) becomes or remains smooth and does not exhibit pronounced hills and valleys, folds and/or other types of unsightly and undesirable irregularities.

It is preferred to plasticize the material of the outer wall 7 as a result of repeated high-frequency mechanical stressing of the blank B in the region between the clamping and bending devices by one or more tools, such as the rotatable roller-shaped tool 10 which is shown in FIG. 1 mounted at the upper end of an elongated holder constituting a straight two-armed lever 11. The high-frequency mechanical action of the tool 10 upon the material of the outer wall 7 results in shifting of some such material longitudinally of the blank B, i.e., in a reduction of the thickness of the outer wall 7. Some shifting of the material of the outer wall 7 can also take place laterally (i.e., at right angles to the plane of FIG. 1) to increase the width of the third part of the blank during its conversion into the elbow 6. High-frequency plasticizing action upon the material of the outer wall 7 is achieved by resorting to a double-acting hydraulic or pneumatic motor 13 which serves to pivot the lever or holder 11 back and forth in directions indicated by a double-headed arrow Pf1 and regulating means 113 which can reverse the direction of reciprocatory movement of the piston rod 13a of the motor 13 at a desired frequency. The selected frequency may be in the range of between 10 and 40 oscillations per second, e.g, approximately or exactly thirty oscillation. The selected frequency will depend on the nature of the material of the blank B, the thickness of that portion of the third part of the blank which is being converted into the outer wall 7 and/or upon the selected interval of time during which the blank B is to be converted into a spacer S. The high-frequency action of the tool 10 upon the material of the outer wall 7 is comparable to the action of a roller upon dough during kneading whereby the tool 10 moves lengthwise of the blank B along an arcuate path surrounding the abutment 5. Moreover, the width of the third part of the blank B increases or can increase while such third part undergoes conversion into an elbow as a result of bending action of the device 1 simultaneously with plasticizing action of the tool 10. Still further, rolling of the tool 10 around the abutment 5 with simultaneous movement of the tool substantially radially of the abutment 5 entails some shifting of desiccant from the interior of the third part of the blank B so that the desiccant is much less likely to cause cracking or bursting of the blank in the region of the abutment 5. Some widening of the part which is being converted into the elbow 6 also reduces the likelihood of cracking or bursting of the outer wall 7 during conversion of the third part of the blank into an elbow because the desiccant has more room to yield and its resistance to bending of the outer wall 7 is less pronounced.

The tool 10 is an idler roll which is rotatable about the axis of a pin or shaft 8 at the upper end of the upper arm of the two-armed lever or holder 11. The lower end portion of the lower arm of this lever is coupled to the piston rod 13*a* of the motor 13 by a pin 8*a* which is parallel to the pin 8, and the median portion of the lever 11 between the two arms is articulately connected by a pin 14 to an intermediate portion of a second lever 15 forming part of the means for shifting the tool 10 substantially radially of the abutment 5, i.e., transversely of the arcuate path along which the tool 10 moves under the action of the motor 13 and lever 11. When the piston rod 13*a* reciprocates at a frequency which is selected by the regulating means 113, the lever 11 pivots at 14 in directions which are indicated by the double-headed arrow Pf1 so that the peripheral surface of the tool 10 rolls along the exposed convex surface 12 of the progressively deformed outer wall 7. The tool 10 rolls back and forth as indicated by the double-headed arrow above the pivot member 8.

Movement of the tool 10 in the longitudinal direction of the lever 11 is desirable in order to compensate for progressive thinning of that part of the blank B which is being converted into the elbow 7. This ensures that the pressure which the tool 10 exerts upon the adjacent material of the blank B does not decrease during progressive conversion of such blank into a spacer S. As mentioned above, the apparatus can be used for the making of elbows with small or very small radii of curvature. For example, the tool 10 can roll along an arcuate path whose length is not in excess of three centimeters, normally not in excess of two centimeters and often not more than one centimeter. The rolling action is effective not only in the region of the apex of the convex surface 12 on the outer wall 7 but also at least upstream of the apex, as considered in the direction of feed (arrow Pf3) of fresh blanks B into the apparatus. In the illustrated embodiment, the means for pivoting and shifting the tool 10 are designed to ensure a plasticizing in the region of the apex, ahead of the apex as well as downstream of the apex. This ensures that the part which is being converted into the outer wall 7 is readily pliable and that its material can expand in predictable fashion not only longitudinally but also transversely of the elbow 6. The tool 10 can effect a movement of plasticized material toward as well as away from the apex of the convex external surface 12, depending on the nature of application of pressure axially of the lever 11, i.e., whether the tool 10 is urged against the developing elbow 6 while it moves toward or while it moves away from the apex.

The means for shifting the lever 11 axially or longitudinally includes the second lever 15 as well as a motor 16 (e.g., a double-acting hydraulic or pneumatic motor, an electric motor or any other suitable prime mover) which can move the left-hand end portion of the left-hand arm of the lever 15 up and down. The end portion of the right-hand arm of the lever 15 is pivotable about the axis of a fixed pin 17 so that the tool 10 performs a composite movement when the motors 13 and 16 are on. Hydraulic or pneumatic motors which can move their piston rods at a frequency within a wide range of frequencies are well known and are available on the market. The means for regulating the frequency of reciprocation of the piston rod 16*a* of the motor 16 comprises a suitable adjusting unit 116 whose details form no part of the present invention. The selected frequency may be between 10 and 40 oscillations per second, e.g., in the range of or exactly 30 oscillations. The ratio of the lengths of the two arms of the lever 15 is such that the force with which the piston rod 16*a* moves the lever 15 is multiplied in the region where the tool 10 engages the convex surface 12 of the outer wall 7 of the developing or incipient elbow 6. The ratio can be two-to-one or any other multiplication ratio.

As mentioned above, the mandrel-shaped abutment 5 is or can be made integral with the clamping jaw 18 of the bending device 1. The jaw 18 is pivotable with the jaw 4 about the axis 9 of the abutment 5 while the bending device 1 moves the section 2*a* back and forth during conversion of the third part of the blank B into the elbow 6. The jaws 18 and 4 cooperate to prevent deformation of the second part of the blank B during conversion into the section 2*a*.

FIG. 1 further shows that the mandrel or abutment 5 has a flange or cheek which is located in front of the third part of the blank B and prevents or can prevent undue widening or flattening of the material of the third part during conversion into the elbow 6. A similar flange or cheek is or can be provided at the rear end of the abutment 5, and means (not shown) is preferably provided to move the one and/or the other flange or cheek at right angles to the plane of FIG. 1 in order to enable the apparatus to treat different types of blanks with the same degree of predictability and reproducibility. Moreover, the flanges or cheeks at the axial ends of the abutment 5 can be moved apart prior to removal or ejection of the finished spacer S in order to reduce the effort which is needed for such removal or ejection.

The motor 3*a* can be used to merely move the lower jaw 3 of the clamping device into contact with the adjacent first part of a freshly introduced blank B or to actually clamp the first part of the blank against the stationary jaw 19 with a requisite force so that the first part of the blank is held against any movement relative to the frame F. As indicated by broken lines, the jaw 19 and/or the jaw 3 can have laterally extending portions 19*a*, 3*b* which overlie the respective sides of the first part of the blank B to thus even further reduce the likelihood of any undesirable displacement of the first part during conversion of the third part of such blank into an elbow.

The apparatus of FIG. 1 further comprises an ejecting device 20 whose reciprocable plunger 21 can engage the extensions 29 of the finished spacer S in the region of the elbow 6 (adjacent to the inner wall 7*a* of the elbow) in order to expel the finished spacer from the apparatus upon extraction or retraction of the abutment 5 and upon return movement of the bending device 1 to its inoperative position as well as on opening of the clamping device.

The material of the blank B can be an alluminum alloy, steel or even a synthetic plastic substance. The frequency of the rolling, hammering, smoothing and/or kneading action which the tool 10 or another suitable tool exerts upon the material of the outer wall 7 will depend on the nature of the material of the blank B and on the aforediscussed and other parameters including the thickness of the outer wall 7 prior to bending, the temperature of the blank, the interval of time which is allotted for conversion of the blank into a spacer and/or others.

As also stated above, the illustrated rotatory roller-shaped tool 10 is but one of a wide variety of tools which can be used for plasticizing of selected portions of successive blanks during and/or preparatory to conversion of blanks into spacers. For example, the tool 10 can be replaced with a pronounced hammer which strikes against the material of the third part of the blank at a required frequency and is simultaneously shifted lengthwise of the blank to strike at different portions of the outer wall 7. The tool 10 can also be replaced with a skid-shaped smoothing tool which slides back and forth along the outer side 12 of the wall 7 in order to knead such wall and to shift some of its material in the desired direction or directions. Still further, the apparatus can comprise two tools including, for example, the illustrated tool 10 which is caused to roll back and forth in directions indicated by the arrow above the pivot member 8 and a hammer or an analogous tool which performs an auxiliary or additional plasticizing action upon one or more selected portions of the outer wall 7, e.g., in the exact region as well as upstream and downstream of the apex of the convex surface 12. This further reduces the likelihood of cracking or bursting in the region which is most likely to undergo such damage in conventional apparatus. The just mentioned second tool in the form of a hammer can be replaced with a smoothing or kneading tool. It has been found that even a single tool can carry out a highly satisfactory plasticizing and lengthening action upon the outer wall 7 as well as that a roller-shaped or other rotatable tool is even more satisfactory than a hammer, a skid or another non-rotating tool because the roller can turn during movement relative to the third part of the blank so that it can be moved with the exertion of a relatively small force but is nevertheless capable of displacing requisite quantities of material in the desired direction or directions so as to reduce the thickness of the outer wall, to increase the width of the third part of the blank and/or to shift a requisite quantity of desiccant from the interior of the developing elbow with attendant further reduction of the likelihood of damage to the material of the walls 7 and 7*a* during bending of the blank.

The illustrated apparatus can bend a variety of blanks. Thus, each such blank can have a single longitudinally extending compartment for desiccant, it can have several compartments for desiccant, or it can have one or more inner compartments for desiccant and one or more empty outer compartments which are disposed at the outer side of the finished spacer and at the outer side or sides of its elbow or elbows.

As already mentioned above, the illustrated fluid-operated motors 3*a*, 13 and 16 can be replaced with other types of prime movers. For example, the prime mover 16 can be replaced with an orbiting eccentric which is driven by an electric motor or the like and pivots the lever 15 through the medium of a connecting rod. The same holds true for the motor 13. Moreover, the left-hand arm of the lever 15 can be omitted if the output element of the motor 16 transmits motion directly to the pin 14.

Figure 2:
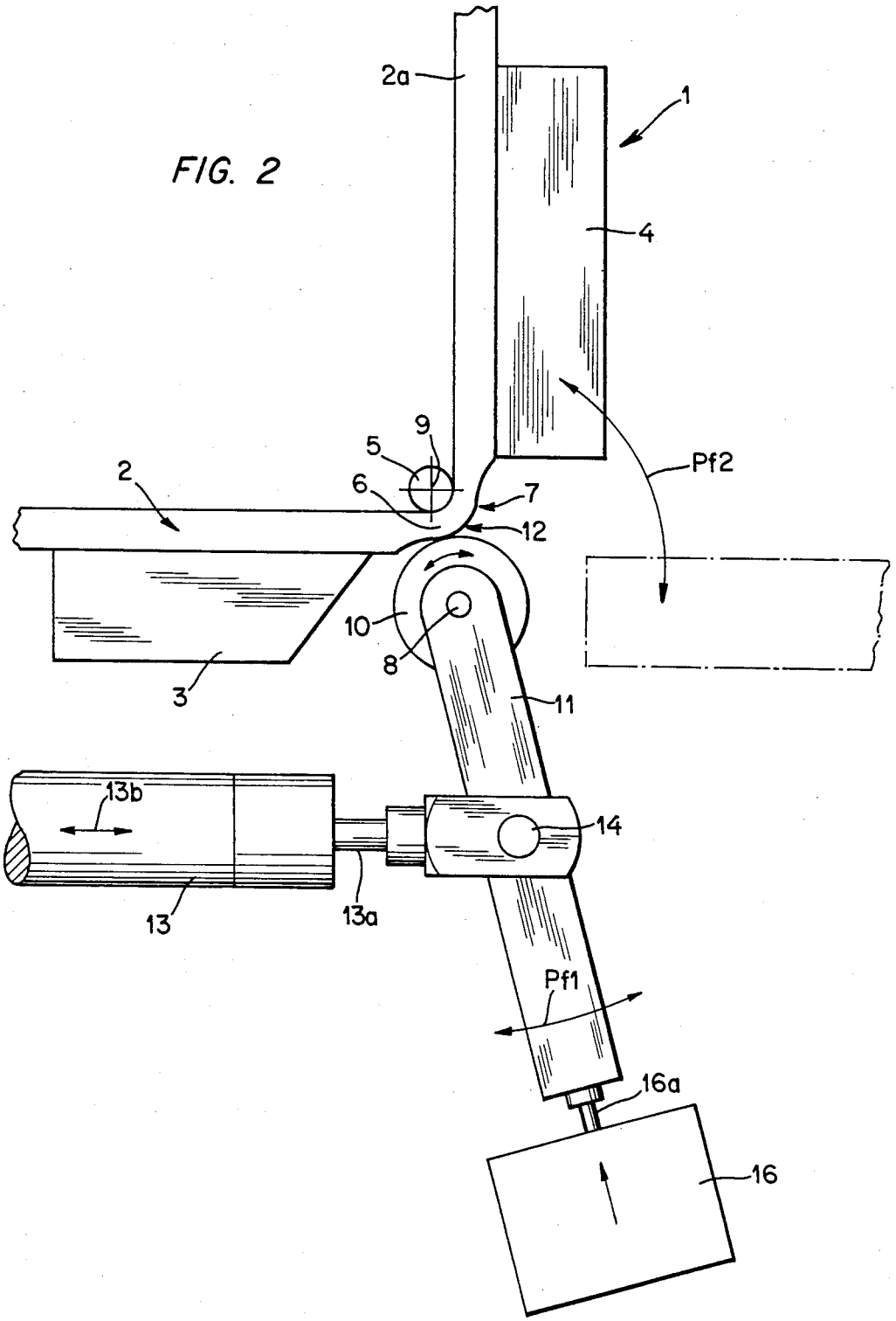
FIG. 2 is a similar schematic elevational view of a second apparatus wherein the means for shifting the plasticizing tool includes a motor which is directly coupled to the holder for the tool.

The apparatus of FIG. 2 differs from the apparatus of FIG. 1 in the construction of plasticizing means for the material of the outer wall 7 of the elbow 6. Thus, the motor 13 is mounted for pivotal movement about an axis which is located to the left of FIG. 2 and this motor is also movable, in its entirety, in the directions indicated by the arrow 13*b*. The piston rod 13*a* is articulately connected directly to the median portion of the holder or lever 11 by a pin 14, and the lever 11 is pivotable with reference to the shifting means which dispenses with the lever 15 of FIG. 1 because the piston rod 16*a* of the motor 16 is attached directly to the lower end portion of the lower arm of the lever 11. The entire motor 16 can pivot about a fixed axis which is also the center of the arcuate path along which the tool 10 moves back and forth under the action of the motor 13, or the major part of the motor 16 can remain stationary if the piston rod 16*a* is pivotable relative to such major part. In the apparatus of FIG. 2, the power amplification ratio of the shifting means for the tool 10 is one-to-one for the sake of simplicity; however, it is evident that another ratio (e.g., two-to-one) can be selected just as well if it is desired to increase the force with which the tool 10 bears against the material of the outer wall 7.

In all other respects, the apparatus of FIG. 2 is or can be identical with the apparatus of FIG. 1.

Numerous experiments with the above apparatus indicate that the provision of plasticizing means, at least for the outer wall 7 of the elbow 6, invariably ensures expulsion of at least some normally incompressible desiccant from the interior of the developing elbow as well as desirable lengthening of that portion of the blank B which is being converted into the outer wall 7 of the elbow. The plasticizing step can begin together with the bending step or earlier and can be terminated simultaneously with or earlier than the bending step. Expulsion of some desiccant renders it possible to more reliably select the desired radius of curvature of the outer wall 7 because the resistance to deformation of the third part of the blank B is reduced as a result of a reduction of the quantity of desiccant in the interior of the part which is being converted into the elbow 6. Cracking or breaking of the elbow 6 is avoided as a result of plasticizing of the respective portion of the blank and also as a result of expulsion of some desiccant from the interior of the elbow, even if the radius of curvature of the elbow is extremely small. It is not necessary to completely expel the desiccant from the interior of the elbow, i.e., the elbow can also contain a supply of incompressible drying agent to ensure that the finished product is capable of keeping moisture out of the space between the major portions of the panes 35 for long periods of time. Moreover, it is not necessary to expel some desiccant from the blank B in advance of the making of one or more elbows, i.e., it is not necessary to resort to vibrators and/or other expelling means and/or to means for gathering and recirculating the expelled desiccant. Repeated movements of the roller 10 or another tool along an arcuate path around the abutment 5 at a high or very high frequency invariably contribute to satisfactory plasticizing of the material of the blank as well as to expulsion of certain quantities of desiccant from the interior of the third part of the blank, i.e., from that part which is being converted into an elbow. Repeated movements of the tool 10 at a high frequency allow for more rapid conversion of the third part of the blank B into an elbow 6. Cold rolling has been found to be highly effective for proper elongation of the wall 7 as well as for satisfactory plasticizing of the material of such wall and expulsion of requisite quantities of desiccant from the developing elbow.

The aforediscussed additional or auxiliary plasticizing action in the region of or only at the apex of the convex surface 12 of the wall 7 renders it possible to return or force sufficient quantities of plasticized material back into that portion of the wall 7 which is most likely to burst or crack, i.e., which is subjected to maximal stresses during conversion of a selected part of the blank B into an elbow 6.

It has been determined that a roller-shaped tool which is mounted and moved in a manner as described in connection with FIGS. 1 and 2 is capable of adequately treating the outer wall 7 during the entire interval of conversion of a selected part of the blank B into an elbow 6. This is due to the fact that the roller 10 can conform to the increasing curvature of the convex surface 12 of the wall 7 when such curvature is minimal as well as when such curvature approaches or matches the curvature of the outer surface of the outer wall of a finished elbow. Thus, the plasticizing action of the roller 10 is satisfactory during each and every stage of the making of an elbow. Utilization of levers as component parts of the means for moving the roller 10 or another selected tool relative to the clamping means 3, 3*a*, 19 during bending of a blank renders it possible to select the force with which the tool acts upon the material of the blank within a very wide range and in a simple, inexpensive and reliable way.

The configuration of the clamping means 3, 3*a*, 19 and bending means 1 is preferably selected in such a way that those parts of the blank B which are to form the sections 2, 2*a* of the spacer S undergo no deformation at all and are invariably held against buckling, lateral bending, squashing and/or other deformations which would affect the appearance and/or utility of the spacer. Nevertheless, the clamping and/or bending means need not necessarily completely surround the respective parts of a blank B so that they can be of lightweight construction and can be manufactured at a reasonable cost. Moreover, such construction of the clamping and bending means provides ample room for installation of the plasticizing means therebetween.

Referring again to FIG. 3 which shows a portion of a spacer S between two window panes 35, the extensions 29 together constitute the bifurcated inner portion 23 of the spacer S and their outer sides are in direct contact with the inner sides of the respective panes 35. The distance b between the outer sides of the extensions 29 slightly exceeds the distance a between the outer sides of the two sidewalls 28 of the tubular portion 22 of the spacer S. These sidewalls are integral with the respective extensions 29 as well as with the respective marginal portions of the generally flat inner wall 26 of the tubular portion 22. The inner wall 26 is weakened by the formation of a longitudinally extending groove 38 in its inner side, and the weakened portion adjacent to the deepmost portion of such groove has one or more rows of perforations 39 which enable desiccant in the compartment 24 of the tubular portion 22 to attract moisture from the space between the panes 35 inwardly of the spacer S so as to prevent fogging or clouding of the inner sides of such panes.

The outer wall 25 of the tubular portion 22 of the spacer S is a composite wall including two mutually inclined walls 27 and a centrally located wall which latter is parallel to the inner wall 26. The planes of the walls 27 are preferably parallel or nearly parallel to the bevelled or chamfered inner end faces 32 of the respective extensions 29; this renders it possible to stack several spacers S in a small area by moving the end faces 32 of the extensions 29 of one spacer against the outer sides of the respective walls 27 on an adjacent spacer and so forth.

The outer sides of the sidewalls 28 of the tubular portion 22 are formed with longitudinally extending recesses or grooves 30 for a sealing and thermally insulating compound 36 and suitable distancing means, e.g., cords 44 of butyl or other suitable elastomeric material. The nature of the sealing compound 36, into which the distancing means 44 are embedded, will depend on a number of factors, including the nature of the material of the spacer S. As mentioned above, such spacer can be made of an aluminum alloy, steel or a synthetic plastic material (but other types of material are not excluded). As a rule, the blanks which are to be converted into spacers are extruded but it is also possible to form such blanks by conversion of strip-shaped metallic or plastic material into tubular bodies with or without extensions. As a rule, the dimensioning of the spacer S is such that it contacts the adjacent inner sides of the two panes 35 only with the outer sides of the extensions 29 whereas the walls of the tubular portion 22 remain out of contact with the panes. This renders it possible that the sealing compound 36 and/or the deformable distancing means 44 expand outwardly (i.e., upwardly, as viewed in FIG. 3) in response to heating and resulting expansion of the materials in the respective grooves 30. Heating normally entails conversion of the sealing compound from a rigid or quasi-rigid state into a plastic state whereby the plasticized material seeks the path of least resistance and expands outwardly along the outer sides of the sidewalls 28 of the tubular portion 22. A more or less rigid barrier 37 can be installed in the innermost portion of each groove 30 to prevent or reduce the likelihood of migration of softened sealing compound 36 toward the outer sides of the respective extensions 29. The provision of grooves 30 in the outer sides of the sidewalls 28 does not adversely influence the formation of elbows 6 because such grooves are located in the neutral plane of the respective blank B. On the contrary, the provision of grooves 30 in the outer sides of the sidewalls 28 facilitates predictable conversion of third parts of the blanks B into elbows 6 having an optimum size and shape.

The inclined end faces 32 can extend all the way to the inner sides of the respective panes 35 or they can terminate short of such inner sides so that each extension 29 further includes a relatively narrow longitudinally extending end face 31 which is parallel to the inner side of the inner wall 26 of the tubular portion 22. The provision of bevelled end faces 32 has been found to contribute significantly to predictable stacking of several spacers S in a common plane so that the generally trapeziform tubular portion 22 of one spacer fits into the space between the extensions 29 of the adjacent spacer. Predictable and compact stacking of spacers S reduces the likelihood of damage during transport and storage to thus reduce the likelihood of leakage of moisture from the surrounding atmosphere into the space between the panes of an assembled multiple-pane window 502 or the like. In fact, the stacking of neighboring spacers may be such that the outer wall 25 of the tubular portion 22 of one spacer actually abuts against the inner side of the inner wall 26 of the tubular portion 22 of the adjacent spacer. This further reduces the space requirements of stacked spacers during transport and/or storage. Also, the amount of packing material can be reduced because a substantial number of spacers can be assembled into a very compact package. Still further, and if the introduction of desiccant takes place prior to making of the elbows, several blanks B can be stacked in the above-described manner so that they can be filled or substantially filled with desiccant in a single operation with attendant reduction of the cost of making the spacers.

As a rule, or at least in many instances, the thickness of the outer wall 25 of the blank preferably exceeds the thickness of the inner wall 26 and/or the sidewalls 28 of each tubular portion 22 so as to ensure that the plasticizing operation with the tool 10 of FIGS. 1 or 2 or with another suitable tool can result in a reduction of the thickness of such outer wall but not to an extent which would be conducive to the development of cracks, breaks or the like. The wall 25 and at least the outermost portions of the sidewalls 28 undergo more or less pronounced elongation during the making of elbows, and the selection of blanks wherein the thickness of the outer wall 25 and/or walls 28 exceeds the thickness of the wall 26 further reduces the likelihood of cracking or similar damage during bending.

FIG. 3 further shows that the outer side of the inner wall 26 of the tubular portion 22, namely the side which is contacted by desiccant in the compartment 24, is formed with several longitudinally extending projections 34 each of which has or can have a triangular cross-sectional outline. The height of the projections 34 is not pronounced and their purpose is to be contacted by a rectangular or trapeziform insert or coupling element 40 (indicated by phantom lines) which is used to couple one end of the illustrated spacer to one end of a second spacer or to couple the two ends of a single spacer to one another so as to form a circumferentially complete spacer along all four marginal portions of each of the two panes 35. The purpose of projections 34 is to compensate for tolerances in the making of the blank B and/or for tolerances in the making of the coupling insert 40. The projections 34 are deformed by the properly introduced insert 40 so that the latter lies flat against the outer side of the wall 26 and greatly reduces the likelihood of escape of desiccant from the compartment 24 and/or penetration of moisture from the surrounding atmosphere into the space between the panes 35 and/or into the compartment 24. The number of inserts 40 will depend on the number of spacers which are needed to form a circumferentially complete distancing device between a pair of window panes. The joint between the ends of a single spacer or the joints between the ends of several spacers are preferably butt joints; however, the utilization of miter joints is not excluded.

Figure 4:
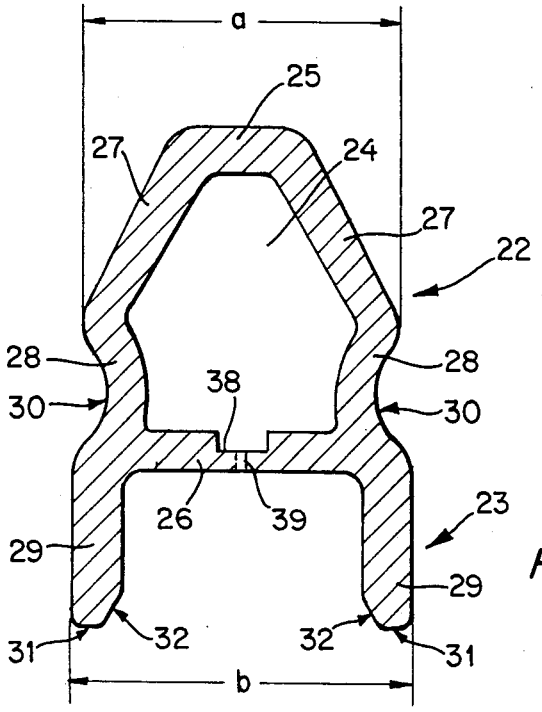
FIG. 4 is a schematic sectional view of a modified (relatively narrow) spacer.

FIG. 4 shows a portion of a modified blank or spacer (depending upon whether or not the part shown in FIG. 4 has one or more elbows) whose width is small in comparison with its thickness. In this spacer or blank, the inclination of edge faces 32 on the extensions 29 of the inner portion 23 of the spacer or blank may but need not conform to or match or even approximate the inclination of the outer sides of the walls 27 of the composite outer wall 25 of the tubular portion 22. In all other respects, the spacer or blank of FIG. 4 is analogous or practically analogous to the structure of FIG. 3 and, therefore, its parts are designated by the same reference characters.

Figure 5:
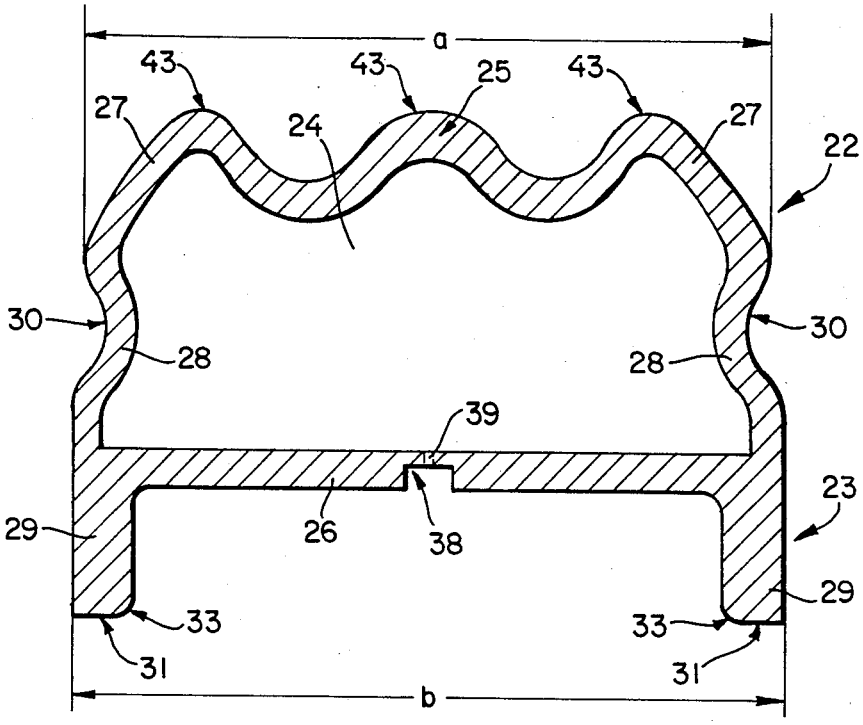
FIG. 5 is a sectional view of a third spacer.

Referring now to FIG. 5, there is shown a blank or spacer wherein the composite outer wall 25 of the tubular portion 22 includes two mutually inclined parts or walls 27 and several intermediate parts or walls which, in their entirety, form an outer wall having an undulate or meandering cross-sectional outline. The inner wall 26 of the tubular portion 22 is flat or substantially flat and the extensions 29 of the inner portion 23 have end faces 31 which are parallel to the sides of the inner wall 26 except that they are slightly rounded along their inner edges, as at 33. This allows for predictable stacking of several blanks or spacers in such a way that the parts or walls 27 of the undulate outer wall 25 of the tubular portion 22 can abut against the rounded portions 33 of the respective extensions 29. The provision of hills 43 and valleys in the outer wall 25 contributes to flexibility of the outer wall and provides additional material during plasticizing of such outer wall for the purpose of providing the blank with one or more elbows.

Figure 6:
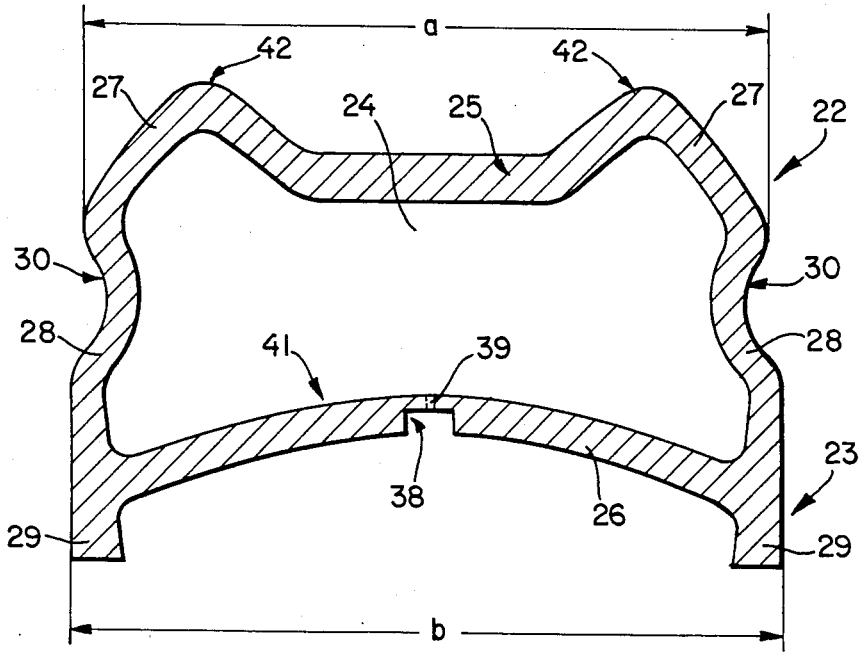
FIG. 6 is a sectional view of a fourth spacer.

FIG. 6 shows a further blank or spacer which is somewhat similar to the article of FIG. 5 except that the inner wall 26 has a concave inner side facing the space between the panes (not shown) and a convex outer side 41 which is contacted by desiccant in the compartment 24. The composite outer wall 25 of the tubular portion 22 has a concavo-convex central portion and two hollow rib-shaped lateral parts 27 with longitudinally extending ridges 42. The rib-shaped lateral parts 27 contain a surplus of material which is necessary during plasticizing and lengthening of those portions of the outer wall 25 which are to constitute the outer wall or walls of one or more elbows. Thus, such ribs provide or store material which renders it possible to ensure that the thickness of the outer wall 7 of an elbow which is formed in the article of FIG. 6 will be constant and need not by less than the thickness of the remaining walls of the elbow.

Figure 7:
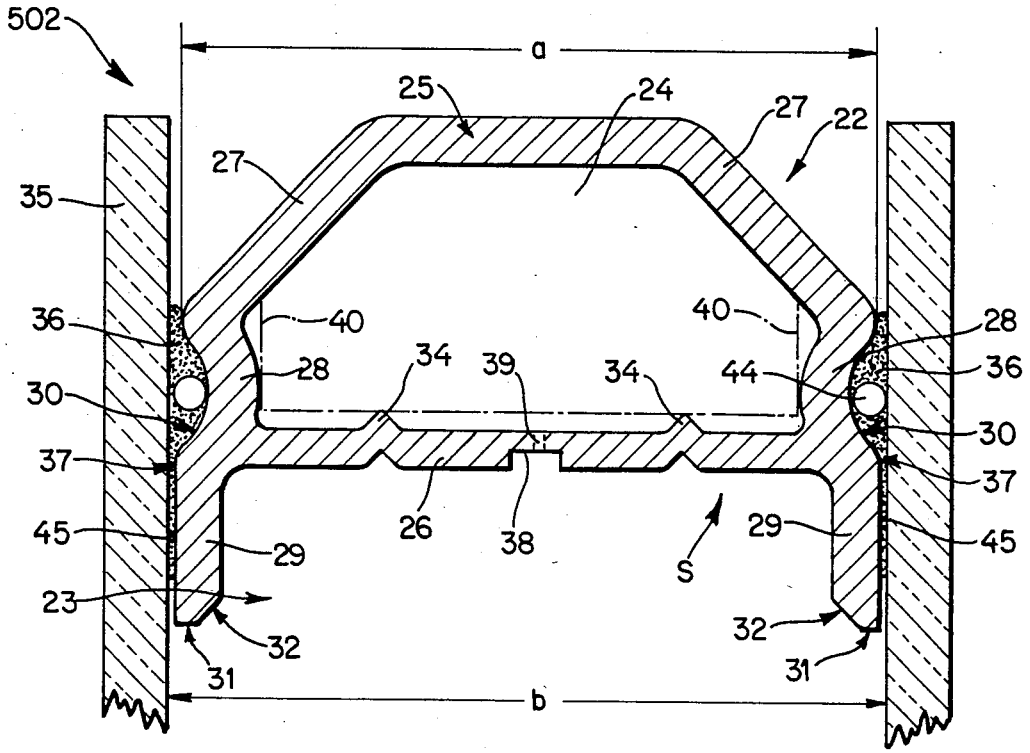
FIG. 7 is a sectional view similar to that of FIG. 3 but showing a modified spacer.

FIG. 7 illustrates a multiple-pane window 502 which is very similar to the structure of FIG. 3 except that the distance between the outer sides of the extensions 29 of the inner portion 23 is somewhat less than the distance b between the inner sides of the panes 35. The resulting narrow clearances between the outer sides of the extensions 29 and the inner sides of the respective panes 35 contain layers 45 of sealing compound 36 which also fills the recesses or grooves 30 in the outer sides of the sidewalls 28 of the tubular portion 22. The layers 45 of sealing compound which fill the narrow clearances can but need not be applied to the outer sides of the extensions 29 prior to insertion of the illustrated spacer between the two panes 35. The same holds true for the sealing compound 36 in the grooves 30 which are formed in the outer sides of the sidewalls 28. The layers 45 along the outer sides of the extensions 29 and in the grooves 30 can be applied prior to conversion of blanks into spacers if the configuration of tools and other parts of the apparatus is such that the tools and other parts do not contact and displace the sealing compound during conversion of blanks into spacers. The parts most likely to dislodge a previously applied sealing compound from the optimum locations on the blank are the tool 10 and the abutment 5 (and the flanges of such abutment) of the apparatus shown in FIGS. 1 or 2.

An advantage of a blank wherein the width a of the tubular portion 22 is less than the distance between the outer sides of the extensions 29 is that the outer sides of the sidewalls 28 need not be contacted by any tools during the making of one or more elbows. Thus, the tool 10 of FIG. 1 will act upon the outer wall 25 of the tubular portion 22 but need not contact the sidewalls 28 so that the sealing compound 36 which has been applied to the outer sides of such sidewalls need not be dislodged or otherwise undesirably influenced during the making of one or more elbows. The lateral expansion or widening of the tubular portion 22 during the making of an elbow can be readily selected in such a way that, in the region of a freshly formed elbow, the width of the tubular portion 22 at most matches the width of the inner portion 23 of the respective spacer. This is advantageous for the making of elbows because the apparatus need not be provided with specially designed restraining means for preventing excessive widening or flattening of the material of the spacer in the region of the elbow. Absence of any restraining means for the sidewalls 28 renders it possible to introduce the sealing compound 36 into the grooves 30 prior to the making of elbows.

The distancing means 44 can be completely embedded in the material of the sealing compound 36 in the respective grooves 30. Each such groove can contain one or more distancing means, depending on the dimensions of the groove and on the dimensions of the distancing means as well as on the resistance of distancing means to deformation. The distancing means 44 can prevent expulsion of excessive quantities of sealing compound 36 from the respective grooves 30 when the panes 35 of the multiple-pane window 502 are caused to move nearer to each other. As mentioned above, the distancing means 44 are preferably made of an elastomeric material, such as natural or artificial rubber. As also mentioned above, each of the distancing means 44 can constitute an elongated cord or it may include one or more elongated portions and/or a series of short portions, e.g., spheres, rolls or the like whereby the spheres or rolls may be immediately adjacent to one another to form practically uninterrupted rows or they may be disposed at intervals with gaps of greater or lesser width between the neighboring rolls or spheres.

The utilization of distancing means is especially desirable and advantageous since, in view of the novel design of blanks which are converted into spacers of the abovedescribed design, the placing of sealing compound 36 into the grooves 30 and the embedding of distancing means 44 into such sealing compound can take place prior to conversion of blanks into spacers, i.e., at a time when the application of sealing compound and distancing means can be carried out at a minute fraction of the cost of applying such substances and parts to relatively small spacers. In other words, each spacer is ready to be inserted between a pair of panes in a multiple-pane window as soon as the making of a requisite number of elbows is completed and as soon as one or more spacers are assembled into a circumferentially complete body normally having a square or rectangular outline.

The layers 45 of sealing compound in the gaps between the outer sides of the extensions 29 and the inner sides of the respective panes 35 shown in FIG. 7 can be obtained by filling the grooves 30 with more sealing compound 36 than necessary and by causing the excess of such sealing compound to flow inwardly toward the end faces 31 of the extensions 29 when the spacer of FIG. 7 is inserted between the panes 35 and such panes are moved toward each other to constitute a double-pane window of preselected thickness. The provision of layers 45 of sealing compound between the panes 35 and the extensions 29 further enhances the thermal insulating properties of the ultimate product. If the layers 45 are formed in the just outlined manner (by expelling the surplus of sealing compound 36 from the grooves 30), the surplus flows over and beyond the respective barriers 37 and this is ensured if the dimensions of the distancing means 44 in the grooves 30 are selected with a view to extend outwardly and beyond the outer sides of the respective sidewalls 28 so as to guarantee that the sealing compound 36 can overflow the barriers 37. Thus, the distancing means 44 can cooperate with the panes 35 to establish gaps of requisite width, i.e., to ensure that the surplus of sealing compound 36 will form two layers 45 of preselected minimum acceptable thickness.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. A spacer for use in multiple-pane windows or the like, comprising an elongated member including an elbow and two sections flanking said elbow, said member having a tubular portion, a supply of desiccant at least partially filling said tubular portion, and two extensions extending laterally of said tubular portion, disposed in two substantially parallel planes and being spaced apart from one another, said extensions having outer sides which are adjacent the inner sides of two spaced-apart panes when the spacer is installed in a multiple-pane window and said tubular portion including two sidewalls having outer sides, the distance between the outer sides of said sidewalls being less than the distance between the outer sides of said extensions and each of said sidewalls being adjacent one of said planes and being integral with the respective extension.

2. The spacer of claim 1, wherein said tubular portion has a substantially rectangular or trapeziform cross-sectional outline.

3. The spacer of claim 1, wherein the outer side of each of said sidewalls has a longitudinally extending groove and said tubular portion includes an inner wall having marginal portions integral with said sidewalls in the regions of the respective grooves.

4. The spacer of claim 1, wherein the outer sides of said sidewalls and/or extensions are provided with layers of a sealing compound.

5. The spacer of claim 4, further comprising distancing means at least partially embedded in said compound.

6. The spacer of claim 5, wherein said distancing means consist of an elastomeric material, such as natural or artificial rubber.

7. The spacer of claim 5, wherein at least one of said distancing means comprises an elongated cord.

8. A spacer for use in multiple-pane windows or the like, comprising an elongated member including an elbow and two sections flanking said elbow, said member having a tubular portion, a supply of desiccant at least partially filling said tubular portion, and two extensions extending laterally of said tubular portion and being spaced apart from one another, said extensions having outer sides and said tubular portion including two sidewalls having outer sides each adjacent the outer side of one of said extensions, the distance between the outer sides of said sidewalls being less than the distance between the outer sides of said extensions and each of said sidewalls being integral with one of said extensions, each of said extensions having a bevelled end face remote from said tubular portion, said bevelled end faces making an angle of less than 180 degrees and being inclined inwardly toward said tubular portion.

9. The spacer of claim 8, wherein said tubular portion includes to mutually inclined outer walls each of which is at least substantially parallel to the end face of one of said extensions and each of which is integral with one of said sidewalls.

10. A spacer for use in pultiple-pane windows or the like, comprising an elongated member including an elbow and two sections flanking said elbow, said member having a tubular portion, a supply of desiccant at least partially filling said tubular portion, and two extensions extending laterally of said tubular portion and being spaced apart from one another, said extensions having outer sides and said tubular portion including two sidewalls having outer sides, the distance between the outer sides of said sidewalls being less than the distance between the outer sides of said extension and the outer side of each of said sidewalls being adjacent the outer side of one of said extensions, each of said sidewalls being integral with one of said extensions; and layers of sealing compound provided on the outer sides of said extensions to sealingly contact the respective panes when the spacer is inserted between the marginal portions of two panes.

11. The spacer of claim 10, wherein the compound includes a thermally insulating mass.

12. The spacer of claim 10, further comprising distancing means provided at the outer sides of said sidewalls and extending beyond the outer sides of the respective extensions so as to contact the respective panes.

13. A spacer for use in multiple-pane windows or the like, comprising an elongated member including an elbow and two sections flanking said elbow, said member having a tubular portion, a supply of desiccant at least partially filling said tubular portion, and two extensions extending laterally of said tubular portion, disposed in two substantially parallel planes and being spaced apart from one another, said extensions having outer sides which are adjacent the inner sides of two spaced-apart panes when the spacer is installed in a multiple-pane window and said tubular portion including two sidewalls having outer sides, the distance between the outer sides of said sidewalls being less that the distance between the outer sides of said extensions and each of said sidewalls being integral with one of said extensions, said tubular portion further including a plurality of longitudinally extending walls including an outer wall whose thickness exceeds the thickness of the remaining walls of said tubular portion, at least in the regions of said sections, said outer wall extending transversely of said extensions and said sidewalls.

14. A spacer for use in multiple-pane windows or the like, comprising an elongated member including an elbow and two sections flanking said elbow, said member having a tubular portion, a supply of desiccant at least partially filling said tubular portion, and two extensions extending laterally of said tubular portion, disposed in two substantially parallel planes and being spaced apart from one another, said extensioins having outer sides which are adjacent the inner sides of two spaced-apart panes when the spacer is installed in a multiple-pane window and said tubular portion including two sidewalls having outer sides, the distance between the outer side of said sidewalls being less than the distance between the outer sides of said extensions and each of said sidewalls being integral with one of said extensions, said tubular portion further including an elongated inner wall having an outer side provided with at least one longitudinally extending projection, said inner wall extending transversely of said extensions and said sidewalls.

15. The spacer of claim 14, wherein said projection has a substantially triangular cross-sectional outline.

16. A spacer for use in multiple-pane windows or the like, comprising an elongated member including an elbow and two sections flanking said elbow, said member having a tubular portion, a supply of desiccant at least partially filling said tubular portion, and two extensions extending laterally of said tubular portion, disposed in two substantially parallel planes and being spaced apart from one another, said extensions having outer sides which are adjacent the inner sides of two spaced-apart panes when the spacer is installed in a multiple-pane window and said tubular portion including two sidewalls having outer sides, the distance between the outer sides of said sidewalls being less than the distance between the outer sides of said extensions and each of said sidewalls being integral with one of said extensions, said tubular portion further including an inner wall and an outer wall, at least a portion of at least one of said inner and outer walls having an arcuate shape.

* * * * *